United States Patent [19]

Lyston

[11] Patent Number: 4,533,088

[45] Date of Patent: Aug. 6, 1985

[54] FROZEN COAL CRACKER

[75] Inventor: Edgar L. Lyston, St. Louis, Mo.

[73] Assignee: American Pulverizer Company, St. Louis, Mo.

[21] Appl. No.: 519,926

[22] Filed: Aug. 3, 1983

[51] Int. Cl.[3] ..... B02C 13/286

[52] U.S. Cl. ..... 241/186.3; 241/189 R; 241/DIG. 17

[58] Field of Search ..... 241/34, 36, 135, 186 R, 241/186.2, 186.3, 189 R, 189 A, 190, 101.7, 285 R, 285 A, 285 B, DIG. 17

[56] References Cited

U.S. PATENT DOCUMENTS

| | | | |
|---|---|---|---|
| 2,643,065 | 6/1953 | Clawson | 241/DIG. 17 |
| 2,954,176 | 9/1960 | Cole | 241/186.3 |
| 4,056,107 | 11/1977 | Todd et al. | 241/186.3 X |
| 4,205,795 | 6/1980 | Graveman | 241/101.7 |

OTHER PUBLICATIONS

American Pulverizer Company, Bulletin 75 FCC.

*Primary Examiner*—Mark Rosenbaum
*Attorney, Agent, or Firm*—Gravely, Lieder & Woodruff

[57] ABSTRACT

A machine for breaking frozen lumps of coal into smaller lumps includes a housing, a rotor which revolves within the housing and has teeth for engaging the coal, and a breaker plate which together with the rotor forms a converging space into which the rotor moves the coal to break up any frozen lumps. In addition, the machine has a baffle plate which at its lower end pivots on the housing and is inclined downwardly toward the rotor so as to direct large frozen lumps of coal into the teeth of the rotor, at least when the machine is configured to process frozen coal. With little effort, the machine may be converted to a by-pass configuration which permits unfrozen coal to pass through the housing without coming into contact with the rotor, and this of course reduces wear on the rotor. To effect this conversion, the breaker plate is swung backwardly to provide a wide space between it and the rotor, and a removable baffle plate is installed in the housing above the rotor such that it is inclined downwardly toward the space between the rotor and the breaker plate. Thereafter, the pivoted baffle plate is swung over against the upper end of the removable baffle plate, and when so disposed it likewise overlies the rotor, but is inclined downwardly toward a space on the opposite side of the rotor. Thus, the two baffle plates divert unfrozen coal to the sides of the rotor.

5 Claims, 7 Drawing Figures

FROZEN COAL CRACKER

BACKGROUND OF THE INVENTION

This invention relates in general to coal handling equipment and more particularly to a machine for breaking frozen lumps of coal.

Much of the coal that is mined in this country is delivered to users in open railway cars or barges. As it leaves the mines this coal is normally in a lump size which is easily handled by conveyors and other handling equipment. However, during the long rail or barge journey the coal may pass through rain and snow storms and acquire a considerable amount of moisture. This does not present much of a problem during the spring, summer and fall, but in winter the moisture often freezes and bonds the small lumps together into large massive lumps which block and disrupt handling equipment. For example, a large lump will not rise along a steeply inclined belt conveyor, but instead will tumble downwardly and carry much of the other coal along with it. Also, large frozen lumps of coal tend to lodge in restricted areas of the conveying equipment, where they produce jams that disrupt the equipment.

To facilitate the handling of coal during winter months frozen coal crackers were developed. The typical frozen coal cracker is a large machine containing a rotor that is provided teeth which pass by a breaker plate. Coal that is dumped into the machine must pass between the cutting teeth and the breaker plate, and of course any large frozen lumps of coal will be broken or cracked to a size suitable for handling. Only during the winter does the machine serve any purpose. During the warmer months the machine merely stands idle with its breaker plate backed off from the rotor so that the coal passes freely through the machine. This, however, causes unnecessary wear on the rotor, and indeed, the wear caused by the free falling coal often exceeds the wear caused from breaking frozen lumps. For this reason, some operators run their coal crackers during the warmer months, merely to reduce the wear and to distribute it more evenly, but this consumes energy and certainly does not eliminate the wear. Other operators remove the rotors from their machines during the warmer months so that the coal passes through the machine housing without encountering the rotor. The rotor for a typical frozen coal cracker, however, is quite heavy, and furthermore the back of the machine and the drive train must be dismantled to free the rotor. This requires a considerable amount of labor.

One system which solves the problem has a carriage on which both a frozen coal cracker and a by-pass chute are mounted, and this carriage shifts such that either the by-pass chute or the frozen coal cracker may be positioned to receive the coal. During warm weather the by-pass chute receives the coal so that the falling coal does not encounter the frozen coal cracker. When temperatures drop below freezing, the carriage is shifted to position the frozen coal cracker for processing the coal. See U.S. Pat. No. 4,205,795. The carriage and the track on which it moves consume a large amount of space, and therefore this system is not satisfactory where space is limited.

SUMMARY OF THE INVENTION

One of the principal objects of the present invention is to provide a machine which will break up frozen lumps of coal in extremely cold weather, yet may be converted to a configuration which permits unfrozen coal to pass through the machine without encountering major components that would otherwise be subjected to substantial wear. A further object is to provide a machine of the type stated which is compact and does not require a large space for its successful operation. Another object is to provide a machine of the type stated that is easily converted between configurations for processing frozen and unfrozen coal. An additional object is to provide a machine of the type stated which contains its own by-pass chute through which unfrozen coal is directed and baffle plates which protect the rotor. Still another object is to provide a machine of the type stated which is simple in construction and economical to operate. These and other objects and advantages will become apparent hereinafter.

DESCRIPTION OF THE DRAWINGS

In the accompanying drawings which form part of the specification and wherein like numerals and letters refer to like parts wherever they occur -

DETAILED DESCRIPTION

Figure 1:
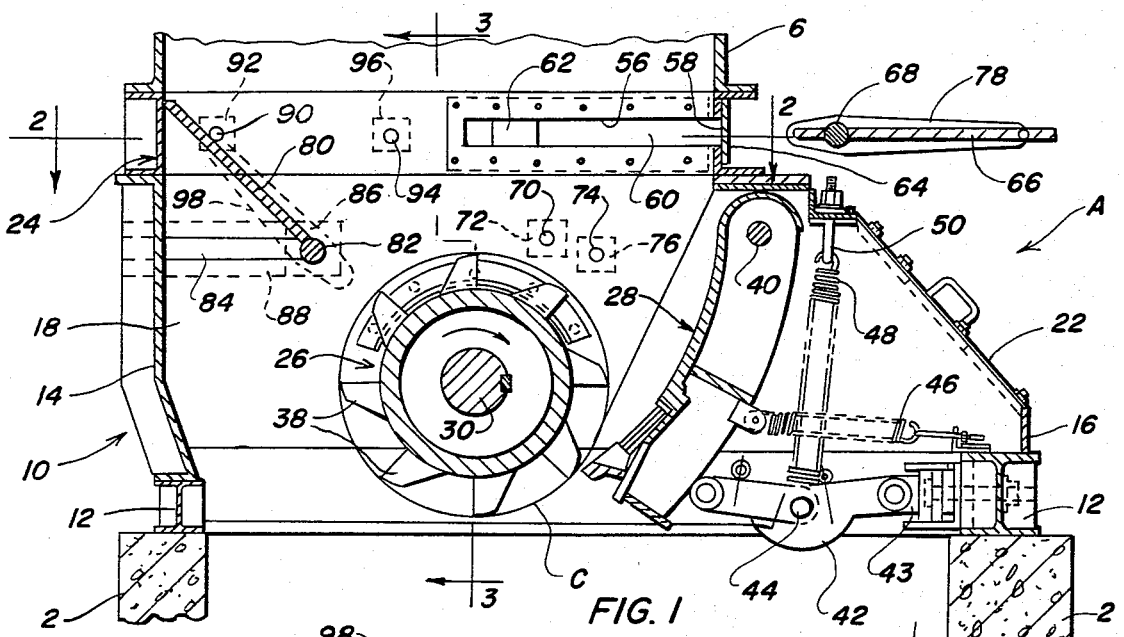
FIG. 1 is a sectional view in elevation of a coal processing machine constructed in accordance with and embodying the present invention, the machine being illustrated in its configuration for processing frozen coal.

Referring now to the drawings, a machine A (FIGS. 1 & 3) for processing frozen coal, also known as a frozen coal cracker, rests on a foundation 2 that surrounds a pit 4 into which the coal falls after passing through the machine A. Normally, a conveyor leads out of the pit 4 to a storage area or some other coal handling apparatus so that the coal is removed from the pit 4 as fast as it enters. The coal is directed into the machine A from a chute 6 which is located above the machine A. The machine A is capable of assuming two modes or configurations, namely, a by-pass configuration (FIG. 4) in which the coal passes through the machine A, without undergoing any reduction in size, and a processing configuration (FIG. 1) wherein the coal, or more accurately coal that is frozen together in lumps, is reduced to lumps that are conveniently handled by coal conveyors and other coal-handling equipment. The by-pass configuration is, of course, used during the spring, summer, and fall months when moisture within the coal does not have any effect on the lump size. The processing configuration, on the other hand, is used during winter months, or more accurately when the temperatures drop below freezing, for it is at these temperatures that the moisture within the coal freezes and bonds the lumps of coal together into massive oversize lumps that are too large for ordinary coal-handling equipment. The frozen coal cracker is easily converted from its by-pass to its processing configuration and vice-versa.

The machine A includes a housing 10 (FIGS. 1 & 3) that is for the most part a weldment which is erected upon a base 12 formed from I-beams and channels. The base 12 is in turn secured to the foundation 2 such that the interior of the housing 10 opens downwardly into the pit 4. The housing 10 has a front wall 14, a rear wall 16 and a pair of spaced apart side walls 18 which extend between the front and rear walls 14 and 16. While the front wall 14 is generally upright and solid throughout, the rear wall 16 is inclined and contains an access door 22. Both the upper and lower ends of the housing 10 are open, the former having an upwardly directed hopper 24 which is bolted to the lower end of the chute 6. The front and side walls of the hopper 24 align with the front and side walls 14 and 18 of the housing 10, but the back wall of the hopper 24 is offset from the back wall 16 of the housing 10.

Figure 3:
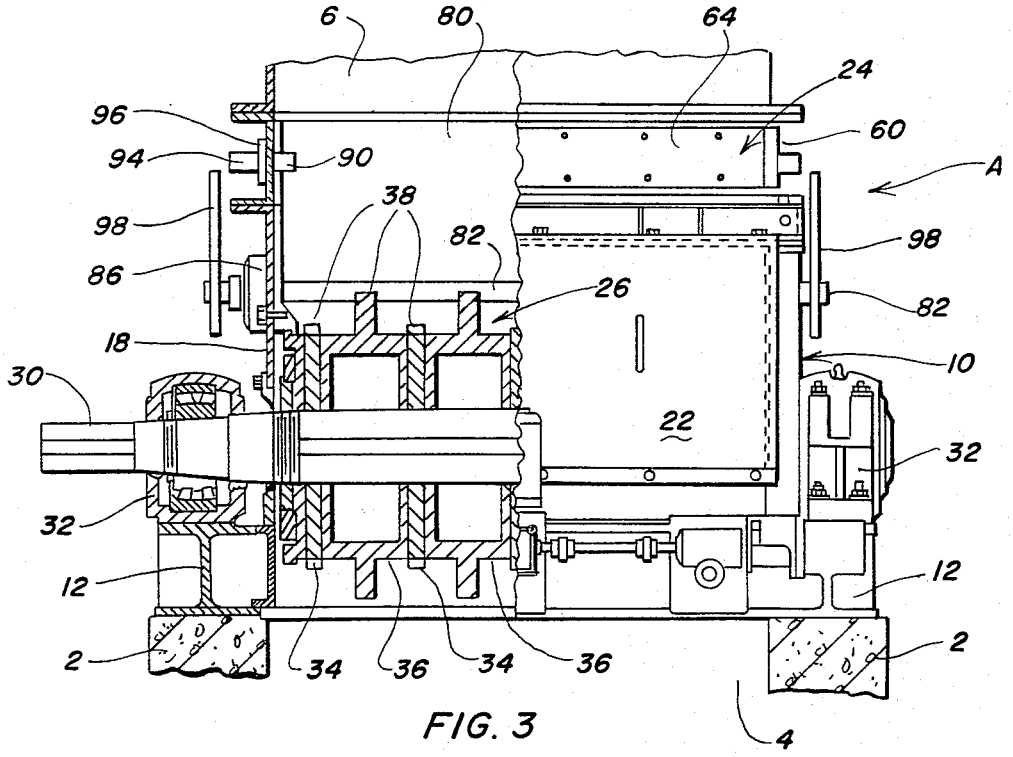
FIG. 3 is a half sectional view of the machine taken along line 3—3 of FIG. 1.

In addition to the housing 10, the machine A includes a rotor 26 and a breaker plate 28 which for the most part are contained within the housing 10. More specifically, the rotor 26 has a shaft 30 which passes through the housing 10 and through the side walls 18, beyond which it is supported in bearings that are contained within pillow blocks 32. The pillow blocks 32 are in turn fastened to the base 12. Within the housing 10 the shaft 30 carries a succession of cutter disks 34 and spacers 36 which are arranged alternately (FIG. 3). Both disks 34 and spacers 36 have teeth 38, with the teeth 38 on the former being offset circumferentially from the teeth 38 on the latter. One end of the shaft 30 extends beyond the pillow block 32 that supports that end, and here the shaft 30 is connected to a motor through a suitable drive train, such as a roller chain and sprockets. The motor turns the rotor 26 at a relatively low velocity, such as 18 to 20 rev/min, and as the rotor 26 revolves its teeth 38 describe a tooth circle c (FIG. 1) that passes close to the lower end of the breaker plate 28 when the machine A is in its processing configuration. Moreover, the direction of rotation is such that the teeth 38 move downwardly opposite the breaker plate 28, and as a consequence large lumps of coal which come into the converging space between the rotor 26 and the breaker plate 28 are engaged by the teeth 38 and broken into smaller lumps.

The breaker plate 28 (FIG. 1), which is arcuate in configuration, is positioned between the rotor 26 and the back wall 16 of the housing 10 with its concave face presented toward the rotor 26, the radius of curvature for that surface being considerably greater than the tooth circle c described by the teeth 38 on the rotor 26. The plate 28 is suspended from a hinge shaft 40 which extends along the upper end of the plate 28 and into the two side walls 18 slightly beyond the back of the hopper 24. Indeed, the concave surface of breaker plate 28 generally aligns with and forms a downward continuation of the back wall of the hopper 24. The hinge shaft 40 enables the breaker plate 28 to swing forwardly and rearwardly within the housing 10 to accommodate the two configurations in which the machine A operates. When the machine A is in its processing configuration (FIGS. 1), the breaker plate 28 is forward with its lower end quite close to the tooth circle c. On the other hand, when the machine A is in its by-pass configuration (FIG. 4), the breaker plate 28 is withdrawn from the rotor 26 so that its concave surface is spaced a substantial distance from tooth circle c.

To position the breaker plate 28 in its forward and rear positions, a toggle linkage 42 (FIGS. 1 & 4) is interposed between breaker plate 28 and that portion of the base 12 that underlies the back wall 16 of the housing 10. The linkage 42 consists of two links which are connected by hinge pins to the breaker plate and to an eye fitting 43 that is at the base 12. The two links are further connected together by another hinge pin 44. The position of the eye fitting 43 on the base 12 is adjustable, and this of course controls the distance between the breaker plate 28 and the tooth circle c when the plate 28 is in its forward position.

When the breaker plate 28 is in its rear position (FIG. 4), the linkage 42 is collapsed and projects below the base 12. On the other hand, when the plate 28 is forward (FIG. 1), the linkage 42 is extended, but not to the extent that it goes over center. Indeed, the linkage 42 is prevented from going over center or even reaching center by a stop that is on one of its links. Extending between the back of the breaker plate 28 and the base 12 is a horizontal spring 46 which urges the plate 28 to its rear position. The spring 46 would ordinarily hold the plate 28 in its rear position were it not for a vertical spring 48 which extends between the hinge pin 44 at the center of the linkage 42 and an adjustable hook 50 that is attached to the inclined back wall 16 near the upper end thereof. The strength of the vertical spring 48 together with the mechanical advantage imparted by the linkage 42 is enough to overcome the force exerted by the horizontal spring 46, so that when the vertical spring 48 is in place, the toggle linkage 42 is extended and the breaker plate 28 is forward. However, the vertical spring 48 is easily detached from the hook 50 by extending that hook, and when so detached, the horizontal spring 46 pulls the plate 28 rearwardly, whereupon the linkage 42 drops downwardly. The breaker plate 28 thereupon assumes its rear position.

Within its sides, the hopper 24 is provided with horizontal slots 56 (FIGS. 1 & 4) that extend from a point generally directly over the rotor 26 rearwardly to the back wall of the hopper 24 where the hopper 24 is provided with another horizontal slot 58 that extends between the two side slots 56. Bolted over each of the side slots 56 is a cover plate 60 that carries a backing block 62 near its remote end (FIGS. 2 & 5), that is near the end that is directly above the rotor 26. The backing block 60, however, is spaced from the end of the slot 56, leaving apertures in each side of the hopper 24, with those apertures being directly above the axis of the rotor 26. The slot 56 in the back wall of the hopper 24 is covered by a back cover plate 64. When the frozen coal cracker A is in its processing configuration, the cover plates 60 and 62 are in place and the hopper 24 is unobstructed so that coal from the chute 6 will fall through the hopper 24 and directly onto the rotor 26.

Figure 4:
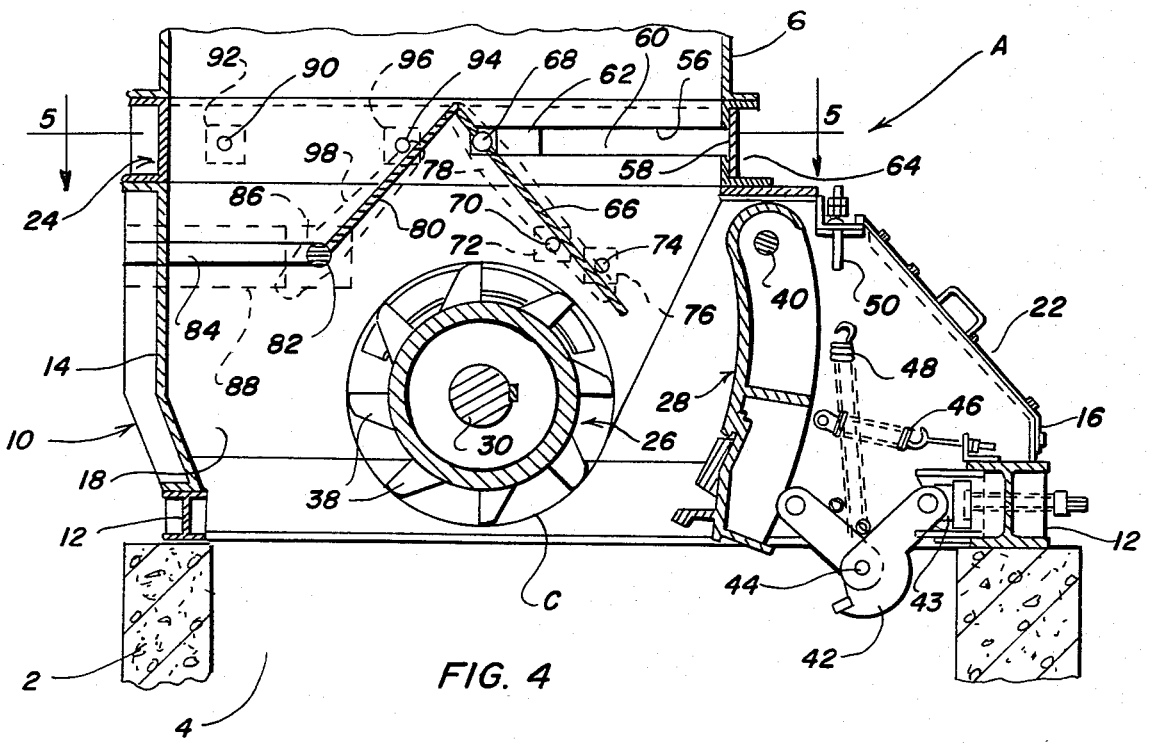
FIG. 4 is a sectional view in elevation of the machine in its by-pass configuration.
Figure 5:
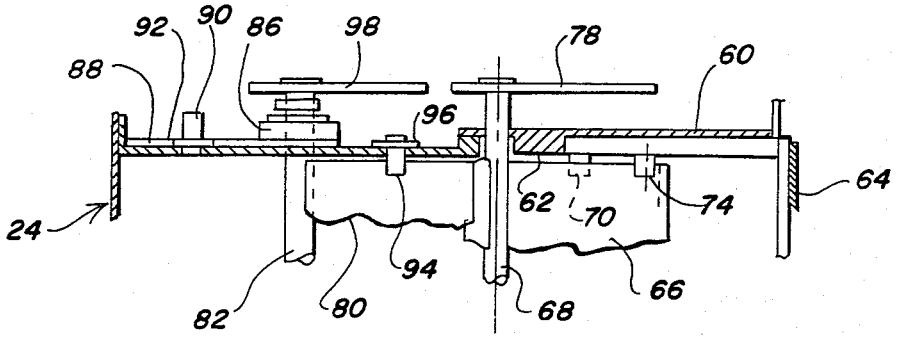
FIG. 5 is a fragmentary sectional view taken along line 5—5 of FIG. 4.

While the slots 56 and 58 have no function in the processing configuration for the machine A, they serve to accept and position a baffle plate 66 for the by-pass operation of the machine A (FIGS. 4 & 5). In this regard, the baffle plate 66 is about as wide as the space between the side walls 18 of the housing 10, and near one of its ends it is provided with a pivot shaft 68 that projects beyond the side margins of the plate 66. The diameter of the pivot shaft 68 is slightly less than the width of the slots 56 and 58 so that the shaft 68 will fit through the slots 56 and 58 when the cover plates 60 and 64 are removed. Indeed, when the baffle plate 66 is positioned for by-pass operation of the machine A, the pivot shaft 68 projects through the apertures at the ends of the slots 56 and are against the backing blocks 62 on the cover plates 64. The distance from the shaft 68 to the rear margin of the baffle plate 66 is slightly less than the distance from the forward ends of the hopper 24 to the rear of the hopper 24, so that once the shaft 68 is at the ends of the side slots 56, the plate 66 can pivot downwardly to an inclined position wherein it generally overlies the rear half of the rotor 26. When so positioned, the lower or rear end of the plate 66 rests on retaining pins 70 which project through the side walls 18 of the housing 10. Each retaining pin 70 is fastened firmly to a small mounting plate 72 which is in turn bolted against one of the side walls 18 of the housing 10 to secure the pin 70 firmly in place. The pins 70 may also be reversed by bolting their plates 72 to the side walls 18 with the pins 70 projecting outwardly. In that condition the pins 70 do not obstruct the interior of the housing 10, yet the holes which they would otherwise occupy are covered. To prevent the baffle plate 66 from swinging upwardly, more retaining pins 74 project into the housing 10, but these pins overlie the lower end of the plate 66. Each pin 74 is likewise attached to a mounting plate 76 which may be bolted to the housing 10 with the pin 74 projecting inwardly or outwardly.

While the major portion of the baffle plate 66 lies rearwardly from the hinge shaft 68, a short segment projects in the opposite direction, and when the plate 66 is secured in its inclined position by the retaining pins 70 and 74 and by the side cover plates 60, this short segment projects upwardly at the same inclination as the major portion of the plate 66, its end margin being slightly below the upper end of the hopper 24 (FIG. 4).

Finally, at each end of the shaft for the baffle plate 66 a lever arm 78 is attached to the shaft 68. The lever arms 78 lie parallel to the plate 66 itself, and inasmuch as they are at the exterior of the housing 10, they indicate the angular position of the baffle plate 66 within the housing 10. They further serve to apply torque to the shaft 68 so that the plate 66, once released from the retaining pins 74 may be turned to a horizontal position and withdrawn through the slots 56 and 58 of the hopper 24, assuming of course, that the cover plates 60 and 64 are removed from the hopper 24.

Figure 2:
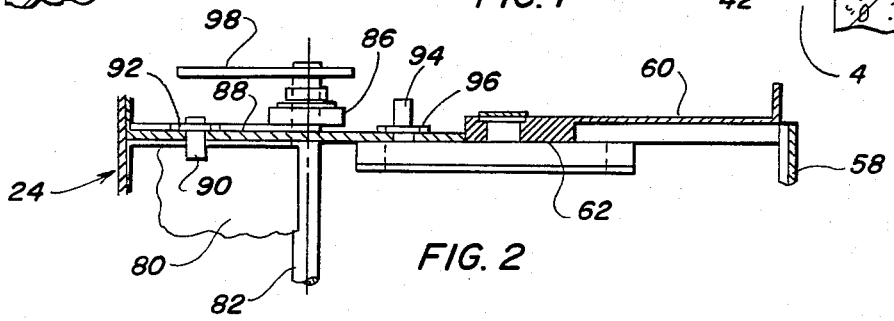
FIG. 2 is a fragmentary sectional view of the machine taken along line 2—2 of FIG. 1.

The front wall 14 of the housing 10 is spaced somewhat from the rotor 26 and located generally above the space between the two is another baffle plate 80 (FIGS. 1 and 4) that is capable of swinging between two inclined positions. In the one position it is generally over the space between front wall 14 and the rotor 26 and is inclined downwardly toward the rotor (FIG. 1). It is this position that the plate 80 assumes when the machine A is in its processing configuration. In the other position, the plate 80 is generally over the rotor 26 and is inclined downwardly toward the front wall 14 (FIG. 4). This is the position that the plate 80 assumes when the machine A is in its by-pass configuration.

The baffle plate 80 has a pivot shaft 82 at its lower end, and this shaft projects laterally into slots 84 that are located in the side walls 18 of the housing 10. Indeed, the pivot shaft 82 extends into bearing blocks 86 (FIGS. 2, 3 & 5) that are bolted to the side walls 18 and thereby cover the ends of the slots 18. In this regard, the slots 84 extend forwardly from the bearing blocks 86 all the way to the front margins of the side walls 18. This enables the pivot shaft 82 to pass forwardly through the slots 84, once the bearing blocks 86 are removed, and out of the housing 10, assuming of course that the front wall 14 is also removed. Thus, the baffle plate 80 may, with relative ease, be removed from the housing 10 for repair or replacement. The portions of the slots 84 beyond the bearing blocks 86 are closed with cover plates 88.

The baffle plate 80 extends no lower than its pivot shaft 82, and that shaft is located at about the elevation of the top of the tooth circle c and is further spaced from both the front walls 14 of the housing 10 and the rotor 26, it being somewhat closer to the latter than the former. When the baffle plate 80 is inclined downwardly toward the rotor 26 (FIG. 1), its upper end rests against the front wall of the hopper 24 and it is this position that the plate 80 assumes when the machine A is in its processing configuration. The baffle plate 80 is prevented from moving upwardly out of this position by retaining pins 90 (FIGS. 1–3) which project inwardly from mounting plates 92 that are bolted to the outside face of the side wall 18. The pins 90 may be installed in the reverse position to free the baffle plate 80 so that it may pivot. The plate 80 cannot be moved to its other position, that is the position in which it is inclined downwardly toward the front wall 14, until the baffle plate 66 is installed in its inclined position on the other side of the rotor 26, for the upper end of the plate 80 rests against the upper end of the plate 66 when the plate 80 is inclined downwardly toward the front wall 14. When the two plates 66 and 80 are so disposed (FIG. 4), the rotor 26 is completely shielded or covered from above, and this is the position of the plates 66 and 80 when the machine A is in its by-pass configuration. The baffle plate 80 is prevented from moving upwardly away from the plate 66 by retaining pins 94 (FIGS. 4 & 5) which project inwardly from the side wall of the hopper 24 and overlie the plate 80. Each pin 94 is attached to a mounting plate 96 which is bolted against the outside face of the hopper 24, and these pins may be installed in the reverse position to free the baffle plate 80 so that it may pivot.

Fitted to the outer ends of the pivot shaft 82 are lever arms 98 through which torque is applied to the baffle plate 80 to move it between its two positions. The arms 98 are parallel to the plate 80 and thereby indicate the angular position of the plate 80 within the housing 10.

As previously observed, the machine A is capable of assuming two configurations and corresponding modes of operation, namely a processing configuration and mode (FIG. 1) and a by-pass configuration and mode (FIG. 4). When in the processing configuration (FIGS. 1–3), the machine is suitable for reducing large forzen lumps of coal to a manageable size. When in the by-pass configuration, the machine A merely serves as an extension of the chute 6 and does not process the coal. To place the machine A in its processing configuration, the vertical spring 48 is connected between the hook 50 and the pivot pin 44 of the toggle linkage 42, thus causing the linkage 42 to extend. This in turn projects the breaker plate 28 forwardly, so that its lower end is close to the tooth circle c described by the teeth 38 of the rotor 26. The baffle plate 66 is completely removed from the machine A and stored nearby, and the slots 56 and 58 in the hopper 24 are closed by the cover plates 60 and 64. The two retaining pins 70 and 74 for the plate 66 are mounted such that they project outwardly from the housing 10, so that their mcunting plates 72 and 76 close the apertures through which they would otherwise project into the housing 10. The other baffle plate 80 is positioned such that it is inclined downwardly toward the rotor 26, in which case its upper end rests against the front wall of the hopper 24. The retaining pins 90 project inwardly to prevent the plate 80 from being displaced upwardly, whereas the other retaining pins 94 project outwardly so that their mounting plates 96 cover the holes through which they would otherwise project.

Frozen coal enters the machine through the hopper 24, and most of it falls directly onto the rotor 26 or between the rotor 26 and the breaker plate 28. The teeth 38 of the rotor 26 bite into any large frozen lumps of coal and reduce those lumps to a size suitable for handling equipment. Some of the coal drops onto the baffle plate 80 and any lumps which are too large to pass between the pivot shaft 82 at the lower end of that plate and the teeth 38 on the rotor 26 are engaged by those teeth and broken into lumps of more manageable size. Thus, the coal which passes out of the bottom of the machine A contains no large lumps of frozen coal and is therefore in a size suitable for handling in subsequent equipment.

To convert the machine to its by-pass configuration (FIGS. 4 & 5), which is desirable when the coal does not contain frozen lumps, the vertical spring 48 is at its upper end detached from the hook 50. This allows the toggle linkage 42 to drop downwardly midway between its ends which in turn causes the breaker plate 28 to withdraw from the rotor 26. Indeed, when the toggle linkage 42 is collapsed, the breaker plate 28 assumes a retracted position in which it is spaced a considerable distance from the rotor 26. Thereafter, the side and rear cover plates 60 and 64 for the hopper 24 are removed, exposing the side and front slots 56 and 58 of the hopper 24. Next the baffle plate 66 is gripped at its lever arms 78 and is lifted upwardly in a horizontal disposition to be aligned with the slot 58 in the back wall of the hopper 24. Indeed, the baffle plate 66 is directed into the back slot 58 and also the slots 56 in the side walls of the hopper 24. The plate 66 is advanced until its pivot shaft 68 comes against the ends of the side slots 56, in which case the shaft 68 is located directly above the axis of rotation for the rotor 26. Also the retaining pins 74 are mounted on the side walls 18 of the housing 10 such that they project into the interior of the housing 10. Once the far end of the baffle plate 66 clears the back wall of the hopper 24, it is allowed to swing downwardly and come to rest on the retaining pins 70. The cover plates 60 and 64 are then installed to close the slots 56 and 58 in the hopper 24, and thereafter the other retaining pins 74 for the baffle plate 66 are installed such that they project into the housing 10, in which case they will lie over the baffle plate 66 and prevent it from displacing upwardly off of the pins 70.

Once the baffle plate 66 is in place, the retaining pins 90, which prevent the baffle plate 80 from swinging upwardly, are removed so as not to obstruct the baffle plate 80. Moreover, the other retaining pins 94 are likewise projected outwardly from the housing 10 so as to enable the baffle plate 80 to swing upwardly over center and then down against the upper end of the baffle plate 66. Then the retaining pins 94 are installed such that they project inwardly over the baffle plate 80 and prevent it from lifting away from the plate 66. The retaining pins 90, on the other hand, are bolted against the housing 10 such that they project away from the housing 10.

The two baffle plates 66 and 80 form a peaked shield or cover over the rotor 26, and that cover diverts any coal that is directed toward the rotor 26 from above to the sides of the rotor 26, whence it falls downwardly through the spaces between the front wall 14 and the rotor 26 and between the breaker plate 28 and the rotor 26. Thus, the falling coal does not impinge against the teeth 38 or other surfaces of the rotor 26. As a consequence, the life of the rotor 26 is prolonged and the rotor 26 need not be rotated to facilitate the passage of coal through the machine A. Even though the baffle plates 66 and 80 cover the rotor 26, they do not interfere with it, and as a consequence the rotor 26 may be turned when the machine A is in its by-pass configuration.

The machine A is returned to its processing configuration by reversing the sequence of the foregoing steps.

Figure 7:
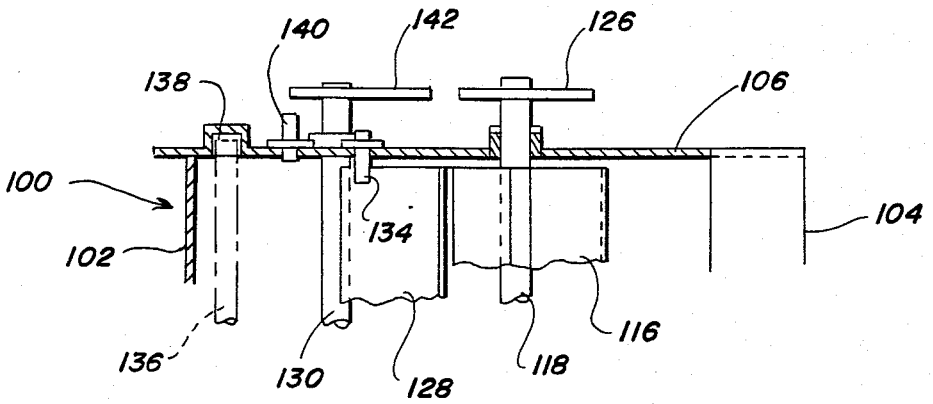
FIG. 7 is a sectional view taken along line 7—7 of FIG. 6.

The machine A is somewhat taller than conventional coal crackers inasmuch as its housing 10 has the hopper 24 which, while extending its height somewhat, facilitates installation and removal of the baffle plate 66. Thus, the machine A at some existing installations may not be easily substituted for a conventional coal cracker, that is one which does not have that baffle plate 66 and 80. A modified machine B (FIGS. 6 and 7) possesses this capability.

The modified machine B has a housing 100 that includes a front wall 102, a back wall 104 and side walls 106. The top of the housing 100 is for the most part open, and the chute 6 is bolted to the housing 100 around the opening in its top, instead of to an upwardly directed hopper as holds true with the machine A. The chute 6 is easily detached from the housing 100 merely by loosening and removing a few bolts, and when so detached it should be free to move upwardly about six inches to provide an access space between the lower end of the chute 6 and the upper end of the housing 100. The machine B also has a rotor 110, a breaker plate 112, and a toggle linkage 114, all of which are the same as their counterparts in the machine A.

Like the machine A, the machine B has a removable baffle plate 116 which includes a pivot shaft 118, but the shaft 118 is located generally midway between the ends of the plate 116 instead of at one end. When the machine B is in its processing configuration, the baffle 116 is removed from the housing 110 and merely stored. However, when the machine B is in its by-pass configuration, the plate 116 fits within the housing 100 and chute 6, it being located generally over the rotor 100 where it is inclined downwardly toward the space between breaker plate 112 and the rotor 110. To this end the baffle plate 116 is narrow enough to fit between the side walls 106 of the housing 100, but the pivot shaft 118 projects beyond the sides of the plate 116. Its outwardly projecting portions are received in sockets 120 which open upwardly out of the side walls 106 of the housing 100. The side walls 106 also carry retaining pins 122 which extend beneath the plate 116 and prevent it from pivoting into the teeth of the rotor 110. When the plate 116 is installed in its operative position within the housing 100, its upper portion projects into the chute 6, and near its upper end it is provided with a boss 124 that projects toward the front wall 102 of the housing 100. The boss 124, however, is set slightly below the upper edge of the plate 116, so that a forwardly opening notch exists along the upper edge of the plate 116. Attached to the outer ends of the pivot shaft 118 are lever arms 126 which lie parallel to the plate 116 and indicate the angular position of the plate 116 within the housing 100 and chute 6. More importantly, the lever arms 126 facilitate installation of the baffle plate 116 in, and removal of it from, the housing 100.

Indeed, to install the baffle plate 116 within the housing 100, the chute 6 is detached from the upper end of the housing 100 and lifted upwardly about six inches. Then the baffle plate 116 is gripped at its lever arms 126 and maneuvered in a horizontal orientation into the space between the upper end of the housing 100 and the chute 6. The plate 116 is advanced through that space until the projecting portions of its pivot shaft 118 align with the sockets 120 in the side walls 106 of the housing 100, whereupon the plate 116 is lowered until its pivot shaft 118 comes to rest within the sockets 120. Then, by applying torque at the lever arms 126, the plate 116 is rotated until it comes to rest against the retaining pins 122. The plate 116 thus assumes the correct angular position within the housing 100.

In addition to the removable baffle plate 116, the modified machine B has a pivoted baffle plate 128 which at its lower end includes a pivot shaft 130 that extends through the side walls 106 of the housing 100 and rotates in bearing blocks 132 that are bolted to those side walls 106. When the machine B is in its by-pass configuration, the baffle plate 128 is inclined downwardly toward the space between the front wall 102 and the rotor 110, and its upper end fits into the notch formed by the boss 124 at the upper end of the removable baffle plate 116. The pivoted baffle plate 128 is prevented from swinging upwardly out of this position by retaining pins 134 which project through the side walls 106 and overlie the plate 128. The boss 124 on the removable plate 116, prevents the pivoted plate 128 from swinging in the opposite direction, that is, downwardly. The removable plate 116, on the other hand, rests at its upper end against the upper end of the pivoted plate 128, and thus the removable plate 116 is confined in one direction of rotation by the retaining pins 122 and in the other by the pivoted plate 128.

Figure 6:
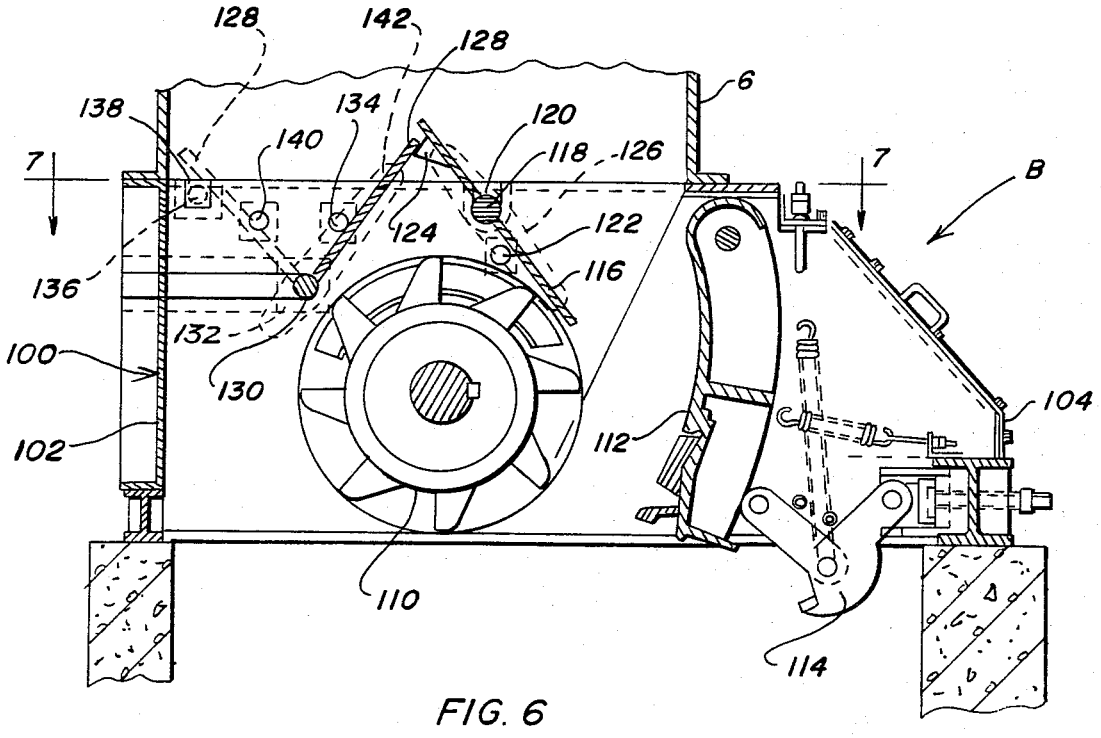
FIG. 6 is a sectional view in elevation of a modified coal processing machine in its by-pass configuration, but showing in phantom lines its pivoted baffle plate and support bar in the positions they assume when the machine is in its processing configuration.

When the machine B is in its processing configuration, that is when the removable plate 116 is withdrawn from the housing 100, the pivoted plate 128 is inclined downwardly toward the rotor 110 and its upper edge is quite close to the front wall of the chute 6 (as illustrated in phantom lines in FIG. 6). However, the plate 128 does not rest against the chute 6, but instead rests on a bar 136 (also illustrated in phantom lines in FIGS. 6 and 7) that fits into sockets 138 which open out of the upper ends of the side walls 106. To prevent the plate 128 from lifting off of the bar 136, the side walls 106 of the housing 100 are fitted with more reversible retaining pins 140. The bar 136 is removed from the housing 100 when the machine B is in its by-pass configuration, and this removal is easily achieved when the chute 6 is elevated slightly above the housing 100.

The pivoted baffle plate 128 has lever arms 142 attached to the ends of its pivot shaft 130, and through these arms a torque may be applied to the shaft 130 to swing the plate 128 between its two positions.

The modified machine B functions essentially the same as the machine A. When in its processing configuration, the pivoted baffle plate 128 directs coal toward the rotor 110, whereas the removable baffle plate 116 is stored remote from the machine B. On the other hand, when the machine B is in its by-pass configuration, the two baffle plates 116 and 128 form a peak over the rotor 110, while the breaker plate 112 is retracted, and coal is thereby diverted to the sides of the rotor 110.

This invention is intended to cover all changes and modifications of the example of the invention herein chosen for purposes of the disclosure which do not constitute departures from the spirit and scope of the invention.

What is claimed is:

1. In a machine for accommodating coal flow during warm weather conditions and cold weather conditions and for further processing the coal during cold weather conditions when small lumps of coal are frozen together to form large lumps, and in which a housing having side walls defines a passage for coal flow from an inlet to an outlet and a frozen coal disintegrating rotor is operably mounted in the housing and spaced from opposite side walls; the improvement comprising: first and second baffle plates movably mounted with respect to the housing, said baffle plates having processing positions in which the first baffle plate is positioned to direct the frozen lumps of coal toward the rotor and the second baffle plate is retracted from the housing to permit frozen lumps of coal to reach and be broken up by the rotor; breaker means operably mounted in the housing in spaced relation to the rotor and movable between a first position to cooperate with the rotor for breaking up lumps of frozen coal and a position removed from cooperation with the rotor; means for arranging said pair of baffle plates in the housing in adjacent cooperating by-pass positions over the rotor for protecting the rotor from contact by the entering coal flow, the baffle plates when in their cooperating by-pass positions generally forming a peak over the rotor with the first plate sloping downwardly from the peak toward one side of the rotor and the second plate sloping downwardly from the peak toward the other side of the rotor; and means for positioning said breaker means in its retracted position relative to the rotor when the baffle plates are in the cooperating by-pass positions, so that coal flows over the baffle plates and past both sides of the rotor.

2. A machine according to claim 1 wherein said first baffle plate is provided with a pivot near one end within the housing and is movable between a first position in which it is located generally inclined at an angle over the rotor and thereby diverts coal away from the rotor and a second position in which it is located to the side of the rotor.

3. A machine according to claim 1 wherein there are spaces within the housing one each side of the rotor, and the first baffle plate when it is generally inclined over the rotor directs coal flow into the space on one side of the rotor and when it is to the side of the rotor generally covers that one space and directs coal flow toward the rotor.

4. A machine according to claim 1 wherein the second baffle plate when retracted from the housing is completely removable from the housing when the first baffle plate is located to direct the coal flow toward the rotor.

5. A machine according to claim 1 wherein the second baffle plate, when positioned in the housing is located above the rotor to shield the rotor from coal flow, said second baffle plate inclines toward the space at one side of the rotor so that coal flow which falls through the inlet is deflected into the space at one side of the rotor and passes through the housing generally without coming against the rotor.

* * * * *